US007004660B2

(12) United States Patent
Kaempf

(10) Patent No.: US 7,004,660 B2
(45) Date of Patent: Feb. 28, 2006

(54) CLOSURE CAP WITH REFILLING FUNCTION

(75) Inventor: Karl-Peter Kaempf, Marloffstein (DE)

(73) Assignee: Schwan-STABILO Schwanhausser GmbH & Co. KG, Heroldsberg (DE)

( * ) Notice: Subject to any disclaimer, the term of this patent is extended or adjusted under 35 U.S.C. 154(b) by 64 days.

(21) Appl. No.: 10/744,177

(22) Filed: Dec. 23, 2003

(65) Prior Publication Data

US 2004/0146335 A1 Jul. 29, 2004

(30) Foreign Application Priority Data

Jan. 29, 2003 (EP) ..... 03002056

(51) Int. Cl.
*B43K 5/00* (2006.01)

(52) U.S. Cl. ..... 401/202; 401/198

(58) Field of Classification Search ..... 401/196, 401/198, 199, 202

See application file for complete search history.

(56) References Cited

U.S. PATENT DOCUMENTS

| | | | | |
|---|---|---|---|---|
| 2,416,596 | A * | 2/1947 | Rosenthal | 401/199 |
| 2,673,362 | A * | 3/1954 | Robinson | 401/186 |
| 2,947,015 | A * | 8/1960 | Burt | 401/183 |
| 3,475,103 | A | 10/1969 | Danjczek | |
| 6,102,602 | A * | 8/2000 | Kageyama et al. | 401/269 |

FOREIGN PATENT DOCUMENTS

| | | |
|---|---|---|
| DE | 9108841.0 | 9/1992 |
| EP | 1 442 899 | 8/2004 |
| FR | 2.108.898 | 5/1972 |

* cited by examiner

*Primary Examiner*—David J. Walczak
(74) *Attorney, Agent, or Firm*—Bachman & LaPointe, P.C.

(57) ABSTRACT

A wet writing implement comprises a shaft (30) for holding a capillary writing tip (32) and a closure cap (10) which can be reversibly fitted on to the shaft (30) for protecting the writing tip (32). Arranged in the closure cap (10) is a writing fluid storage device (12) for receiving a writing fluid.

9 Claims, 1 Drawing Sheet

CLOSURE CAP WITH REFILLING FUNCTION

BACKGROUND OF THE INVENTION

The present invention concerns a wet writing implement comprising a shaft for holding a capillary writing tip, a closure cap reversibly fitted on to the shaft for protecting the writing tip, and a writing fluid storage means for receiving a writing fluid arranged in the closure cap.

Wet writing implements of that kind are used for example in the form of so-called markers which deliver a fluorescent marking fluid for the purposes of clearly indicating for example printed passages of text. In order to prevent the capillary writing tip from drying out when the writing implement is not in use, a closure cap can be fitted on to the shaft of the implement in such a way that the writing tip is covered over with respect to the ambient atmosphere.

As a consequence of the high costs of producing writing implements of that kind, it is desirable not to have to throw them away after the first filling of writing fluid has been consumed, but it is desirable to be able to refill them with writing fluid. Various design configurations have been adopted for that purpose in practice. Thus for example wet writing implements are known in which a fluid-tightly closable refilling opening is provided on the shaft of the writing implement. However, that alternative design is comparatively expensive as a consequence of the need to provide a sealing but repeatedly disconnectable connection between the filling opening and a corresponding closure element. A further design configuration involves providing a writing fluid reservoir, the content of which is pressed into the writing implement by way of the writing tip. That forcible filling procedure frequently results in the storage means of the writing implement being overfilled, and at the beginning of use of the writing implement after the refilling operation that results in an increased delivery of writing fluid.

Besides the possibility of being able to refill the implement with writing fluid, the attempt may also be made to increase the storage capacity of the writing fluid storage means. However, that alternative is frequently confronted with design reasons as a writing implement of that kind should not be of an excessive width and/or length.

The object of the present invention, in a wet writing implement of the kind set forth in the opening part of this specification, is to optimally arrange the writing fluid storage means having regard to a high storage capacity and/or the design of the writing implement.

SUMMARY OF THE INVENTION

The foregoing object is attained by providing a shaft for holding a capillary writing tip, a closure cap reversibly fitted on to the shaft for protecting the writing tip, and a writing fluid storage means for receiving a writing fluid arranged in the closure cap.

Arranging the writing fluid storage means in the closure cap provides that the closure cap which for example for design reasons is frequently of a voluminous nature is usefully employed insofar as the dead volume present there at least partially accommodates the writing fluid storage means. In addition, by virtue of its direct contact with the writing fluid storage means disposed in the closure cap, the writing tip is optimally saturated with writing fluid. The design configuration adopted is also inexpensive at it can be produced by machine. In addition the division of a comparatively large or long shaft and a comparatively small closure cap, which is frequently to be found in known writing implements, can be altered in such a way that the size of the closure cap to the size of the shaft is 1:1 or 2:1 and so forth. Finally, the operation of refilling the wet writing implement can be effected either by the closure cap with an empty writing fluid storage means being simply replaced by a new closure cap with a full storage means or however by the contact location between the capillary writing tip and the storage means in the closure cap being used for the refilling operation in a simple fashion as it is easily accessible.

The fluid storage means can be arranged in the closure cap in various ways. An advantageous configuration here provides that disposed in the closure cap is a separating wall which is arranged at a spacing relative to the end portion of the closure cap and which delimits the fluid storage means with respect to the cap entry opening for the shaft and which has an orifice through which, when the closure cap is fitted on to the shaft, the capillary writing tip can come into fluid-conducting contact with the writing fluid stored in the writing fluid storage means. That prevents particles of dirt from entering the writing fluid storage means. In addition, depending on the respective configuration of the writing fluid storage means, the orifice for receiving the capillary writing tip can be used as a refilling opening for the writing fluid when the first filling of writing fluid in the storage means of the closure cap has been completely taken therefrom.

In order to facilitate transfer of the writing fluid from the writing fluid storage means in the closure cap to the capillary writing tip, it is advantageous if the capillarity or the effect of the capillary action of the writing fluid storage means in the closure cap is less than that of the capillary writing tip and that of a further storage means which is possibly present in the shaft.

In order further to increase the storage capacity of the writing implement it can further be provided that a further or second writing fluid storage means is arranged in the interior of the shaft. In that way, virtually any dead space present in the writing implement is usefully employed as a writing fluid storage means.

In that respect it is advantageous if the capillarity of the writing fluid storage means arranged in the shaft is less than that of the capillary writing tip but greater than that of the writing fluid storage means in the closure cap.

In order in this case also to prevent damage to the writing fluid storage means in the shaft by for example particles of dirt from the surroundings penetrating therein, it can further be provided that the writing fluid storage means provided in the shaft is closed off with respect to the exterior by a cover wall which preferably holds the capillary writing tip.

The writing fluid storage means in the closure cap and/or in the shaft can be formed by a sponge or a fibre material. It will be appreciated that it is also possible to use any other suitable material.

Particularly inexpensive manufacture of the wet writing implement according to the invention can be achieved in that the separating wall arranged in the cap and/or the cover wall provided on the shaft is fluid-tightly mounted by means of ultrasonic welding to the closure cap or to the shaft respectively.

BRIEF DESCRIPTION OF THE DRAWINGS

Further advantageous configurations and an embodiment of the wet writing implement according to the invention are described hereinafter with reference to the accompanying drawings. In that connection it is to be pointed out that the terms 'left', 'right', 'down' and 'up' used in the description of the specific embodiment relate to the drawings with the reference numerals and legends in the Figures being normally readable. In the drawings.

DETAILED DESCRIPTION

Figure 1:
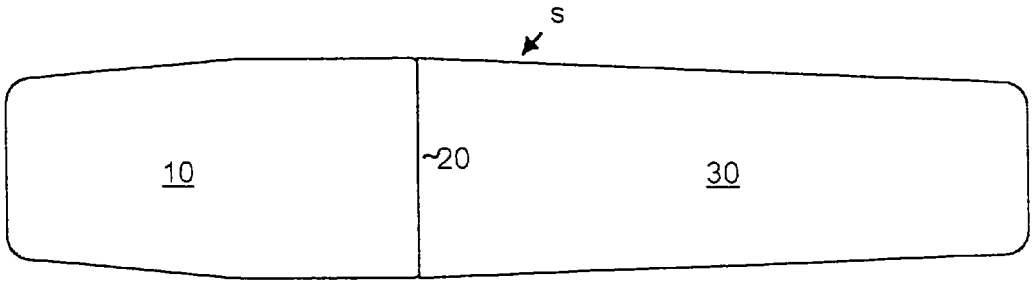
FIG. 1 shows a side view of a wet writing implement according to the invention.
Figure 2:
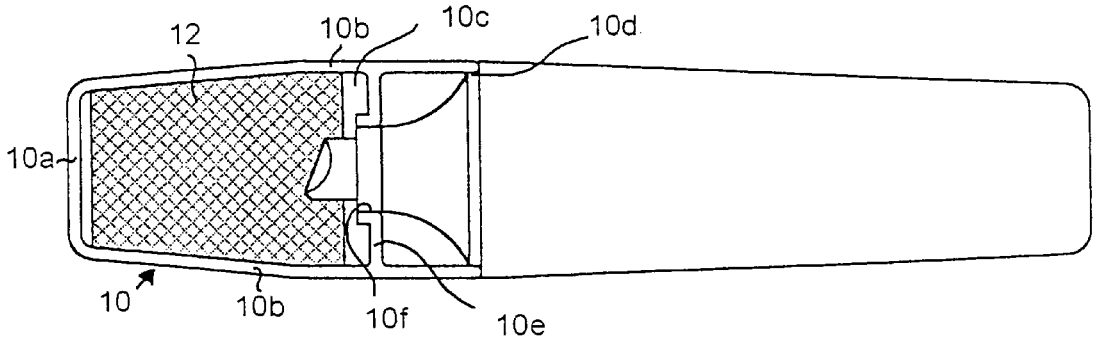
FIG. 2 is a view similar to FIG. 1 but in addition with a closure cap in section.
Figure 3:
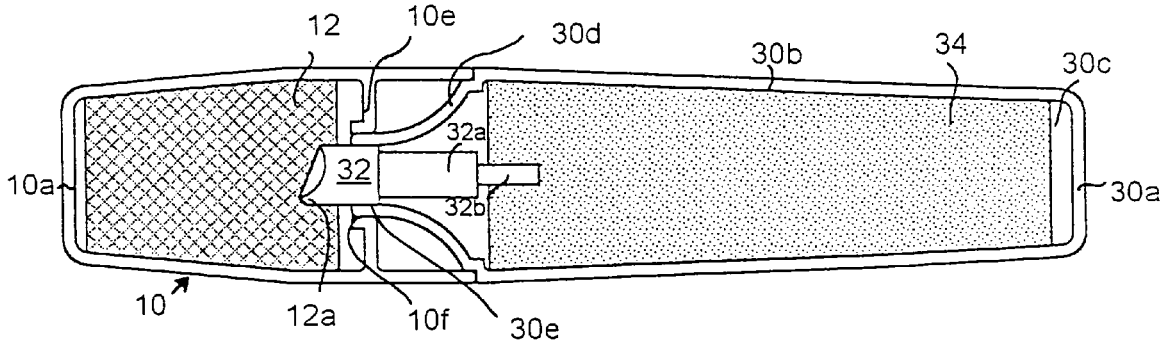
FIG. 3 is a view similar to FIG. 2 but in addition with a shaft in section.

The wet writing implement S according to the invention, as shown in FIGS. 1 to 3, in the illustrated side view involves the external contour of a kite-shaped quadrilateral in which the tips of the two isosceles triangles forming the kite-shaped quadrilateral are cut off. In this arrangement the two cut lines extend parallel to each other and at least approximately perpendicularly to the longitudinal centre line of the wet writing implement S. Although not shown, the thickness of the wet writing implement S, which extends perpendicularly to the plane of the drawings in FIGS. 1 to 3, is a multiple smaller than the longitudinal extent thereof, which is in the plane of the drawing. As can further be seen from FIGS. 1 to 3 the corners of the writing implement S are each rounded off.

As its main components the wet writing implement S according to the invention includes a closure cap 10 and a shaft 30. The closure cap 10 is preferably fluid-tightly fitted on the shaft 30 and possibly latched thereon, but it can be reversibly removed therefrom. In FIG. 1 the separating join between the closure cap 10 and the shaft 30, which extends at least approximately perpendicularly to the longitudinal extent of the writing implement S, is identified by reference 20. It will be seen that the separating join 20 does not coincide with the base which is common to the two triangles of the kite-shaped quadrilateral but is in the region of the closure cap 10.

The closure cap 10 which is made from a suitable plastic material has an end portion 10*a* extending at least approximately perpendicularly to the longitudinal centre line of the closure cap 10 and the writing implement S, as well as side walls 10*b* which directly adjoin the end portion 10*a* and which together define or enclose a hollow space 10*c*. At the side opposite to the end portion 10*a*, that is to say the right-hand side of the closure cap 10, there is an insertion opening 10*d*, by way of which the closure cap 10 can be fitted on to the shaft 30.

Disposed at a spacing relative to the insertion opening 10*d* in the interior of the hollow space 10*c* is a separating wall 10*e* which extends at least approximately perpendicularly to the longitudinal extent of the closure cap 10 or the writing implement S and thus parallel to the end portion 10*a*. The spacing of the separating wall 10*e* from the insertion opening 10*d* in the direction of the longitudinal extent of the closure cap 10 is very much smaller than the spacing of the separating wall 10*e* from the end portion 10*a* of the closure cap 10, as can be seen from FIG. 2. Although shown in FIGS. 2 and 3, the separating wall 10*e* is not in one piece with the side walls 10*b*, but in actual fact is an individual portion which, in production of the writing implement S according to the invention, is fitted into the closure cap 10 after the introduction of a writing fluid storage means 12 described in greater detail hereinafter, and mounted there by an ultrasonic welding operation to the side walls 10*b* of the closure cap 10.

The separating wall 10*e* is provided with an orifice 10*f* which is arranged concentrically with respect to the longitudinal axis of the closure cap 10 or the shaft 30 and which in its shape and dimension corresponds to the configuration of the shaft 30 in the region of a writing tip 32 which will be described in greater detail hereinafter. The orifice 10*f* is delimited in the direction of the end portion 10*a* of the closure cap 10, that is to say towards the left, by bending over the edges of the separating wall 10*e*, which delimit the orifice 10*f*.

Provided in the interior of the closure cap 10 is a first writing fluid storage means 12 which is provided for receiving and storing a writing fluid. In the present case the writing fluid storage means 12 is formed from a fibre material. As can be seen from FIGS. 2 and 3 the writing fluid storage means 12 is arranged at a spacing both with respect to the end portion 10*a* and also the separating wall 10*e* of the closure cap 10. Those two spacings are optional and can both or individually be absent. In addition the storage means 12 is adapted to the shape of the hollow space 10*c* in the interior of the closure cap 10.

The shaft 30 which is or can also be made from a suitable plastic material, in particular the same plastic material as that of the closure cap 10, also has an end portion 30*a* extending at least approximately perpendicularly to the longitudinal centre line of the shaft 30 and side walls 30*b* which directly adjoin the end portion 30*a* and which together define or enclose a hollow space 30*c*. At the side in opposite relationship to the end portion 30*a* the shaft 30 is provided with a cover wall 30*d* which is connected by way of an ultrasonic welding operation to the side walls 30*b* of the shaft 30.

As can be seen in particular from FIG. 3 the cover wall 30*d* is in the form of a cone with concavely inwardly curved side walls and opens in a circular opening 30*e* arranged concentrically with respect to the longitudinal axis of the shaft 30 or the closure cap 10. The outside diameter of the opening 30*e* substantially corresponds to the inside diameter of the orifice 10*f* of the closure cap 10 so that, when the closure cap 10 is fitted on to the shaft 30, the portion of the cover wall 30*d*, which delimits the opening 30*e*, can pass into the orifice 10*f* and forms a sealed connection, as shown in FIG. 3.

Fitted into the opening 30*e* is a capillary writing tip 32 which, as is shown in FIG. 3, is of a wedge-shaped external contour extending in a bevelled configuration from bottom left towards top right. The capillary writing tip 32 projects outwardly by way of the opening 30*e*, in the direction of the closure cap 10. Therefore, when the closure cap 10 is fitted on, the capillary writing tip 32 can come into fluid-conducting contact into a recess 12*a*, of a configuration corresponding to the shape of the writing tip 32, in the writing fluid storage means 12 of the closure cap 10.

As can also be seen from FIG. 3, arranged in the interior of the hollow space 30*c* is a second writing fluid storage means 34 which is at a respective spacing with respect to the end portion 30*a* and the cover wall 30*d*. In addition the writing fluid storage means 34 is adapted to the shape of the shaft 30.

The writing fluid storage means 34 is in fluid-conducting communication with the capillary writing tip 32 by way of writing fluid-conducting elements 32*a*, 32*b* of the capillary writing tip 32. The capillarity of the second storage means 34 is less than that of the writing tip 32 but greater than that of the first writing fluid storage means 12 in the closure cap 10. That provides that, when the closure cap 10 is fitted on the shaft 30, as a consequence of the capillarity difference between the first storage means 12 and the writing tip 32 on the one hand and between the first and the second storage means 12, 34 on the other hand, the writing fluid in the first writing fluid storage means 12 can admittedly pass from the first storage means 12 into the writing tip 32 but not into the second storage means 34. When the closure cap 10 is removed from the shaft 30, the writing fluid, as a consequence of the capillarity difference between the writing tip 32 and the second storage means 34, passes from the storage means 34 to the writing tip 32.

In this connection it is also to be pointed out that filling of the first writing fluid storage means 12 is preferably to be effected when the closure cap 10 is in a lying position. In addition, a compact form of the closure cap 10 and/or the storage means 12 is advantageous to prevent the writing fluid from issuing from the first storage means 12 when the closure cap 10 is in an unfavourable position.

The arrangement of a writing fluid storage means 12 in the closure cap 10 is advantageous in particular also in many wet writing implements S of differing colours. If the capillary writing tip 32 of a wet writing implement S according to the invention, which is supplied with one colour from the second writing fluid storage means 34 is 'dipped' into the closure cap 10 of a different colour, that makes it possible to produce a mixed colour. As the amount of writing fluid picked up is proportional to the period of time for which a closure cap 10 is fitted on a shaft 30 or on a writing tip 32, it is therefore possible to achieve a controlled mixing effect. As the writing fluid which was last refilled is contained in the writing tip 32 in a high level of concentration, it is possible to produce a fluid colour transition while the writing tip 32 is being emptied and writing fluid is then flowing along from the second storage means 34.

The invention claimed is:

1. A wet writing implement comprising a shaft (30) for holding a capillary writing tip (32), a closure cap (10) reversibly fitted on to the shaft (30) for protecting the writing tip (32), a writing fluid storage means (12) for receiving a writing fluid arranged in the closure cap (10), a further writing fluid storage means (34) is arranged in the interior of the shaft (30), wherein capillarity of the further writing fluid storage means (34) arranged in the shaft (30) is less than that of the writing tip (32) but greater than that of the writing fluid storage means (12) in the closure cap (10).

2. A wet writing implement according to claim 1, wherein the closure cap has an end portion **(10*a*) and disposed in the closure cap (10) is a separating wall (10*e*) which is arranged at a spacing relative to the end portion (10*a*) of the closure cap (10) wherein the separating wall (10*e*) and the end portion (10*a*) defines the fluid storage means (12), the closure cap has a cap entry opening (10*d*) for the shaft (30) and the separating wall has an orifice (10*f*) through which, when the closure cap (10) is fitted on to the shaft (30), the capillary writing tip (32) can come into fluid-conducting contact with the writing fluid stored in the writing fluid storage means (12)**.

3. A wet writing implement according to claim 1, wherein the further writing fluid storage means (34) is defined in part by a cover wall **(30*d*) which holds the capillary writing tip (32)**.

4. A wet writing implement according to claim 3, wherein the cover wall **(30*d*) is fluid-tightly mounted by means of ultrasonic welding to the shaft (30)**.

5. A wet writing implement according to claim 1, wherein at least one of the writing fluid storage means (12, 34) is formed of a sponge or a fibre material.

6. A wet writing implement according to claim 1, wherein the capillary writing tip (32) is of a bevelled wedge-shaped configuration.

7. A wet writing implement comprising a shaft (30) for holding a capillary writing tip (32), a closure cap (10) reversibly fitted on to the shaft (30) for protecting the writing tip (32), a writing fluid storage means (12) for receiving a writing fluid arranged in the closure cap (10), the closure cap has an end portion **(10*a*) and disposed in the closure cap (10) is a separating wall (10*e*) which is arranged at a spacing relative to the end portion (10*a*) of the closure cap (10) wherein the separating wall (10*e*) and the end portion (10*a*) defines the fluid storage means (12), the closure cap has a cap entry opening (10*d*) for the shaft (30) and the separating wall has an orifice (10*f*) through which, when the closure cap (10) is fitted on to the shaft (30), the capillary writing tip (32) can come into fluid-conducting contact with the writing fluid stored in the writing fluid storage means (12), wherein the separating wall (10*e*) is fluid-tightly mounted to the closure cap (10)**.

8. A wet writing implement according to claim 7, wherein capillarity of the writing fluid storage means (12) in the closure cap (10) is less than that of the writing tip (32).

9. A wet writing implement according to one of claim 7, wherein a further writing fluid storage means (34) is arranged in the interior of the shaft (30).

* * * * *

UNITED STATES PATENT AND TRADEMARK OFFICE

CERTIFICATE OF CORRECTION

PATENT NO. : 7,004,660 B2
APPLICATION NO. : 10/744177
DATED : February 28, 2006
INVENTOR(S) : Karl-Peter Kaempf It is certified that error appears in the above-identified patent and that said Letters Patent is hereby corrected as shown below:

Col. 6, line 35; Claim 7, line 12, after "orifice" insert --wherein an edge of the orifice contacts the shaft when the closure cap is fitted to the shaft and--.

Signed and Sealed this

Sixth Day of March, 2007

JON W. DUDAS
*Director of the United States Patent and Trademark Office*